US009381740B2

(12) United States Patent
Hoisington et al.

(10) Patent No.: US 9,381,740 B2
(45) **Date of Patent: *Jul. 5, 2016**

(54) INK JET PRINTING

(71) Applicant: FUJIFILM Dimatix, Inc., Lebanon, NH (US)

(72) Inventors: Paul A. Hoisington, Hanover, NH (US); Deane A. Gardner, Cupertino, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 9 days.

This patent is subject to a terminal disclaimer.

(21) Appl. No.: 14/202,029

(22) Filed: Mar. 10, 2014

(65) Prior Publication Data

US 2014/0184677 A1 Jul. 3, 2014

Related U.S. Application Data

(63) Continuation of application No. 11/321,941, filed on Dec. 29, 2005, now Pat. No. 8,708,441.

(60) Provisional application No. 60/640,538, filed on Dec. 30, 2004.

(51) Int. Cl.

| | |
|---|---|
| ***B41J 29/38*** | (2006.01) |
| ***B41J 2/045*** | (2006.01) |
| *B41J 2/14* | (2006.01) |

(52) U.S. Cl.

CPC ..... *B41J 2/04588* (2013.01); *B41J 2/04581* (2013.01); *B41J 2/04596* (2013.01); *B41J 2/04598* (2013.01); *B41J 2002/14403* (2013.01)

(58) Field of Classification Search

CPC ..... B41J 2/04588; B41J 2/04581; B41J 2/04598; B41J 2/04596; B41J 2002/14403

USPC ..... 347/11, 10

See application file for complete search history.

(56) References Cited

U.S. PATENT DOCUMENTS

| | | | |
|---|---|---|---|
| 2,892,107 | A | 6/1959 | Gravley et al. |
| 3,946,398 | A | 3/1976 | Kyser et al. |
| 4,005,440 | A | 1/1977 | Amberntsson |
| 4,051,582 | A | 10/1977 | Eschler et al. |
| 4,104,646 | A | 8/1978 | Fischbeck |

(Continued)

FOREIGN PATENT DOCUMENTS

| | | | |
|---|---|---|---|
| CN | 101094770 | A | 12/2007 |
| DE | 100 11 366 | A1 | 1/2001 |

(Continued)

OTHER PUBLICATIONS

Abstract U.S. Appl. No. 08/808,608, filed Feb. 5, 1997.

(Continued)

*Primary Examiner* — Henok Legesse

(74) *Attorney, Agent, or Firm* — Fish & Richardson P.C.

(57) ABSTRACT

In general, in one aspect, the invention features a method of driving an inkjet module having a plurality of ink jets. The method includes applying a voltage waveform to the inkjet module, the voltage waveform including a first pulse and a second pulse, activating one or more of the ink jets contemporaneously to applying the first pulse, wherein each activated ink jet ejects a fluid droplet in response to the first pulse, and activating all of the ink jets contemporaneously to applying the second pulse without ejecting a droplet.

14 Claims, 5 Drawing Sheets

(56) References Cited

U.S. PATENT DOCUMENTS 4,106,976 A 8/1978 Chiou et al.
4,158,847 A 6/1979 Heinzl et al.
4,189,734 A 2/1980 Kyser et al.
4,216,483 A 8/1980 Kyser et al.
4,266,232 A 5/1981 Juliana, Jr. et al.
4,339,763 A 7/1982 Kyser et al.
4,353,079 A 10/1982 Kawanabe
4,355,256 A 10/1982 Perduijn et al.
4,393,384 A 7/1983 Kyser
4,396,923 A 8/1983 Noda
4,409,596 A 10/1983 Ishii
4,480,259 A 10/1984 Kruger et al.
4,492,968 A 1/1985 Lee et al.
4,504,845 A 3/1985 Kattner et al.
4,510,503 A 4/1985 Paranjpe et al.
4,513,299 A 4/1985 Lee
4,516,140 A 5/1985 Durkee et al.
4,523,200 A 6/1985 Howkins
4,528,574 A 7/1985 Boyden
4,563,689 A 1/1986 Murakami et al.
4,584,590 A 4/1986 Fischbeck et al.
4,620,123 A 10/1986 Farrall et al.
4,627,138 A 12/1986 Im
4,639,735 A 1/1987 Yamamoto et al.
4,641,153 A 2/1987 Cruz-Uribe
4,665,409 A 5/1987 Behrens et al.
4,670,074 A 6/1987 Broussoux et al.
4,672,398 A 6/1987 Kuwabara et al.
4,680,595 A 7/1987 Cruz-Uribe et al.
4,686,539 A 8/1987 Schmidle et al.
4,695,852 A 9/1987 Scardovi
4,695,854 A 9/1987 Cruz-Uribe
4,703,333 A 10/1987 Hubbard
4,714,935 A 12/1987 Yamamoto et al.
4,717,927 A 1/1988 Sato
4,726,099 A 2/1988 Card et al.
4,728,969 A 3/1988 Le et al.
4,730,197 A 3/1988 Raman et al.
4,769,653 A 9/1988 Shimoda
4,774,530 A 9/1988 Hawkins
4,789,425 A 12/1988 Drake et al.
4,812,199 A 3/1989 Sickafus
4,835,554 A 5/1989 Hoisington et al.
4,863,560 A 9/1989 Hawkins
4,891,654 A 1/1990 Hoisington et al.
4,899,178 A 2/1990 Tellier
4,966,037 A 10/1990 Sumner et al.
4,972,211 A 11/1990 Aoki
4,987,429 A 1/1991 Finley et al.
5,000,811 A 3/1991 Campanelli
5,023,625 A 6/1991 Bares et al.
5,041,190 A 8/1991 Drake et al.
5,096,535 A 3/1992 Hawkins et al.
5,109,233 A 4/1992 Nishikawa
5,124,717 A 6/1992 Campanelli et al.
5,124,722 A 6/1992 Moriyama et al.
5,172,134 A 12/1992 Kishida et al.
5,172,139 A 12/1992 Sekiya et al.
5,172,141 A 12/1992 Moriyama
5,173,717 A 12/1992 Kishida et al.
5,202,659 A 4/1993 Debonte
5,202,703 A 4/1993 Hoisington et al.
5,204,690 A 4/1993 Lorenze, Jr. et al.
5,204,695 A 4/1993 Tokunaga et al.
5,221,931 A 6/1993 Moriyama
5,223,937 A 6/1993 Moriguchi et al.
5,227,813 A 7/1993 Pies et al.
5,235,352 A 8/1993 Pies et al.
5,264,865 A 11/1993 Shimoda et al.
5,265,315 A 11/1993 Hoisington et al.
5,278,585 A 1/1994 Karz et al.
5,280,310 A 1/1994 Otsuka et al.
5,285,215 A 2/1994 Liker
5,298,923 A 3/1994 Tokunaga et al.
5,305,024 A 4/1994 Moriguchi et al.
5,329,293 A 7/1994 Liker
5,353,051 A 10/1994 Katayama et al.
5,354,135 A 10/1994 Sakagami et al.
5,361,084 A 11/1994 Paton et al.
5,371,520 A 12/1994 Kubota
5,374,332 A 12/1994 Koyama et al.
5,376,856 A 12/1994 Takeuchi et al.
5,376,857 A 12/1994 Takeuchi et al.
5,381,166 A 1/1995 Lam et al.
5,385,635 A 1/1995 O'Neill
5,387,314 A 2/1995 Baughman et al.
5,402,926 A 4/1995 Takeuchi et al.
5,406,682 A 4/1995 Zimnicki et al.
5,408,739 A 4/1995 Altavela et al.
5,414,916 A 5/1995 Hayes
5,430,344 A 7/1995 Takeuchi et al.
5,438,350 A 8/1995 Kerry
5,446,484 A 8/1995 Hoisington et al.
5,459,501 A 10/1995 Lee et al.
5,463,413 A 10/1995 Ho et al.
5,463,414 A 10/1995 Temple et al.
5,463,416 A 10/1995 Paton et al.
5,466,985 A 11/1995 Suzuki
5,475,279 A 12/1995 Takeuchi et al.
5,477,246 A 12/1995 Hirabayashi et al.
5,477,344 A 12/1995 Lubinsky et al.
5,484,507 A 1/1996 Ames
5,489,930 A 2/1996 Anderson
5,495,270 A 2/1996 Burr et al.
5,500,988 A 3/1996 Moynihan et al.
5,501,893 A 3/1996 Laermer et al.
5,502,471 A 3/1996 Obermeier et al.
5,510,816 A 4/1996 Hosono et al.
5,512,793 A 4/1996 Takeuchi et al.
5,512,922 A 4/1996 Paton
5,518,952 A 5/1996 Vonasek et al.
5,552,809 A 9/1996 Hosono et al.
5,576,743 A 11/1996 Momose et al.
5,581,286 A 12/1996 Hayes et al.
5,581,288 A 12/1996 Shimiu et al.
5,592,042 A 1/1997 Takuchi et al.
5,594,476 A 1/1997 Tokunaga et al.
5,605,659 A 2/1997 Moynihan et al.
5,617,127 A 4/1997 Takeuchi et al.
5,622,748 A 4/1997 Takeuchi et al.
5,631,040 A 5/1997 Takuchi et al.
5,631,675 A 5/1997 Futagawa
5,640,184 A 6/1997 Moynihan et al.
5,643,379 A 7/1997 Takeuchi et al.
5,655,538 A 8/1997 Lorraine et al.
5,657,060 A 8/1997 Sekiya et al.
5,657,063 A 8/1997 Takahashi
5,658,471 A 8/1997 Murthy et al.
5,659,346 A 8/1997 Moynihan et al.
5,665,249 A 9/1997 Burke et al.
5,666,143 A 9/1997 Burke et al.
5,670,999 A 9/1997 Takeuchi et al.
5,689,291 A 11/1997 Tence et al.
5,691,593 A 11/1997 Takeuchi et al.
5,691,594 A 11/1997 Takeuchi et al.
5,691,752 A 11/1997 Moynihan et al.
5,704,105 A 1/1998 Venkataramani et al.
5,710,584 A 1/1998 Suzuki et al.
5,718,044 A 2/1998 Baughman et al.
5,724,082 A 3/1998 Moynihan
5,729,257 A 3/1998 Sekiya et al.
5,731,828 A 3/1998 Ishinaga et al.
5,734,399 A 3/1998 Weber et al.
5,736,993 A 4/1998 Regimbal et al.
5,739,828 A 4/1998 Moriyama et al.
5,745,131 A 4/1998 Kneezel et al.
5,752,303 A 5/1998 Thiel et al.
5,754,204 A 5/1998 Kitahara
5,755,909 A 5/1998 Gailus
5,757,400 A 5/1998 Hoisington
5,777,639 A 7/1998 Kageyama et al.
5,790,156 A 8/1998 Mutton et al.
5,793,394 A 8/1998 Kato
5,798,772 A 8/1998 Tachihara et al.

(56) References Cited

U.S. PATENT DOCUMENTS 5,818,476 A 10/1998 Mey et al.
5,818,482 A 10/1998 Ohta et al.
5,821,841 A 10/1998 Furlani et al.
5,821,953 A 10/1998 Nakano et al.
5,821,972 A 10/1998 Mey et al.
5,825,385 A 10/1998 Silverbrook
5,834,880 A 11/1998 Venkataramani et al.
5,841,452 A 11/1998 Silverbrook
D402,687 S 12/1998 Sabonis
5,850,241 A 12/1998 Silverbrook
5,852,860 A 12/1998 Lorraine et al.
5,855,049 A 1/1999 Corbett, III et al.
5,861,902 A 1/1999 Beerling
D405,822 S 2/1999 Sabonis
5,870,123 A 2/1999 Lorenze, Jr. et al.
5,870,124 A 2/1999 Silverbrook
5,871,656 A 2/1999 Silverbrook
5,880,759 A 3/1999 Silverbrook
5,883,651 A 3/1999 Thiel et al.
5,889,544 A 3/1999 Mey et al.
5,901,425 A 5/1999 Bibl et al.
5,903,286 A 5/1999 Takahashi
5,907,340 A 5/1999 Katakura et al.
5,927,206 A 7/1999 Bacon et al.
5,933,170 A 8/1999 Takeuchi et al.
5,946,012 A 8/1999 Courian et al.
D417,233 S 11/1999 Sabonis
5,975,667 A 11/1999 Moriguchi et al.
5,980,015 A 11/1999 Saruta
5,988,785 A 11/1999 Katayama
5,997,122 A 12/1999 Moriyama et al.
5,997,123 A 12/1999 Takekoshi et al.
6,007,174 A 12/1999 Hirabayashi et al.
6,012,799 A 1/2000 Silverbrook
6,019,457 A 2/2000 Silverbrook
6,020,905 A 2/2000 Cornell et al.
6,022,101 A 2/2000 Sabonis
6,022,752 A 2/2000 Hirsh et al.
6,029,896 A 2/2000 Self et al.
6,030,065 A 2/2000 Fukuhata
6,031,652 A 2/2000 Furlani et al.
6,033,060 A 3/2000 Minami
6,036,874 A 3/2000 Farnaam
6,037,957 A 3/2000 Grande et al.
6,039,425 A 3/2000 Sekiya et al.
6,042,219 A 3/2000 Higashino et al.
6,044,646 A 4/2000 Silverbrook
6,045,710 A 4/2000 Silverbrook
6,046,822 A 4/2000 Wen et al.
6,047,600 A 4/2000 Ottosson
6,047,816 A 4/2000 Moghadam et al.
6,059,394 A 5/2000 Moriyama
6,062,681 A 5/2000 Field et al.
6,067,183 A 5/2000 Furlani et al.
6,070,310 A 6/2000 Ito et al.
6,070,959 A 6/2000 Kanbayashi et al.
6,071,750 A 6/2000 Silverbrook
6,071,822 A 6/2000 Donohue et al.
6,074,033 A 6/2000 Sayama et al.
6,084,609 A 7/2000 Manini et al.
6,086,189 A 7/2000 Hosono et al.
6,087,638 A 7/2000 Silverbrook
6,088,148 A 7/2000 Furlani et al.
6,089,690 A 7/2000 Hotomi
6,089,696 A 7/2000 Lubinsky
6,092,886 A 7/2000 Hosono
6,095,630 A 8/2000 Horii et al.
6,097,406 A 8/2000 Lubinsky et al.
6,099,103 A 8/2000 Takahashi
6,102,512 A 8/2000 Torii et al.
6,102,513 A 8/2000 Wen
6,106,091 A 8/2000 Osawa et al.
6,106,092 A 8/2000 Norigoe et al.
6,108,117 A 8/2000 Furlani et al.
6,109,746 A 8/2000 Jeanmaire et al.
6,113,209 A 9/2000 Nitta et al.
6,116,709 A 9/2000 Hirabayashi et al.
6,123,405 A 9/2000 Temple et al.
6,126,259 A 10/2000 Stango et al.
6,126,263 A 10/2000 Hotomi et al.
6,126,846 A 10/2000 Silverbrook
6,127,198 A 10/2000 Coleman et al.
6,140,746 A 10/2000 Miyashita et al.
6,143,190 A 11/2000 Yagi et al.
6,143,432 A 11/2000 deRochemont et al.
6,143,470 A 11/2000 Nguyen et al.
6,149,259 A 11/2000 Otsuka et al.
6,149,260 A 11/2000 Minakuti
6,151,050 A 11/2000 Hosono et al.
6,155,671 A 12/2000 Fukumoto et al.
6,161,270 A 12/2000 Ghosh et al.
6,174,038 B1 1/2001 Nakazawa et al.
6,176,570 B1 1/2001 Kishima et al.
6,179,978 B1 1/2001 Hirsh et al.
6,186,610 B1 2/2001 Kocher et al.
6,186,618 B1 2/2001 Usui et al.
6,188,416 B1 2/2001 Hayes
6,190,931 B1 2/2001 Silverbrook
6,193,343 B1 2/2001 Norigoe et al.
6,193,346 B1 2/2001 Nakano
6,193,348 B1 2/2001 Sekiya et al.
6,209,999 B1 4/2001 Wen et al.
6,213,588 B1 4/2001 Silverbrook
6,214,192 B1 4/2001 Hawkins et al.
6,214,244 B1 4/2001 Silverbrook
6,214,245 B1 4/2001 Hawkins et al.
6,217,141 B1 4/2001 Nakamura et al.
6,217,153 B1 4/2001 Silverbrook
6,217,155 B1 4/2001 Silverbrook
6,217,159 B1 4/2001 Morikoshi et al.
6,218,083 B1 4/2001 McCullough et al.
6,220,694 B1 4/2001 Silverbrook
6,227,653 B1 5/2001 Silverbrook
6,227,654 B1 5/2001 Silverbrook
6,228,668 B1 5/2001 Silverbrook
6,231,151 B1 5/2001 Hotomi et al.
6,234,608 B1 5/2001 Genovese et al.
6,234,611 B1 5/2001 Silverbrook
6,235,211 B1 5/2001 Silverbrook
6,235,212 B1 5/2001 Silverbrook
6,238,044 B1 5/2001 Silverbrook et al.
6,238,115 B1 5/2001 Silverbrook et al.
6,238,584 B1 5/2001 Hawkins et al.
6,239,821 B1 5/2001 Silverbrook
6,241,342 B1 6/2001 Silverbrook
6,241,904 B1 6/2001 Silverbrook
6,241,905 B1 6/2001 Silverbrook
6,241,906 B1 6/2001 Silverbrook
6,244,691 B1 6/2001 Silverbrook
6,245,246 B1 6/2001 Silverbrook
6,245,247 B1 6/2001 Silverbrook
6,247,776 B1 6/2001 Usui et al.
6,247,790 B1 6/2001 Silverbrook
6,247,791 B1 6/2001 Silverbrook
6,247,793 B1 6/2001 Silverbrook
6,247,794 B1 6/2001 Silverbrook
6,247,795 B1 6/2001 Silverbrook
6,247,796 B1 6/2001 Silverbrook
6,248,248 B1 6/2001 Silverbrook
6,248,249 B1 6/2001 Silverbrook
6,248,505 B1 6/2001 McCullough et al.
6,251,298 B1 6/2001 Silverbrook
6,252,697 B1 6/2001 Hawkins et al.
6,254,213 B1 7/2001 Ishikawa
6,254,793 B1 7/2001 Silverbrook
6,255,762 B1 7/2001 Sakamaki et al.
6,256,849 B1 7/2001 Kim
6,257,689 B1 7/2001 Yonekubo
6,258,284 B1 7/2001 Silverbrook
6,258,285 B1 7/2001 Silverbrook
6,258,286 B1 7/2001 Hawkins et al.
6,260,741 B1 7/2001 Pham-Van-Diep et al.
6,260,953 B1 7/2001 Silverbrook
6,263,551 B1 7/2001 Lorraine et al.

(56) References Cited

U.S. PATENT DOCUMENTS 6,264,306 B1 7/2001 Silverbrook
6,264,307 B1 7/2001 Silverbrook
6,264,849 B1 7/2001 Silverbrook
6,267,905 B1 7/2001 Silverbrook
6,270,179 B1 8/2001 Nou
6,273,538 B1 8/2001 Mitsuhashi et al.
6,273,552 B1 8/2001 Hawkins et al.
6,274,056 B1 8/2001 Silverbrook
6,276,772 B1 8/2001 Sakata et al.
6,276,774 B1 8/2001 Moghadam et al.
6,276,782 B1 8/2001 Sharma et al.
6,280,643 B1 8/2001 Silverbrook
6,281,912 B1 8/2001 Silverbrook
6,281,913 B1 8/2001 Webb
6,283,568 B1 9/2001 Horii et al.
6,283,569 B1 9/2001 Otsuka et al.
6,283,575 B1 9/2001 Hawkins et al.
6,286,935 B1 9/2001 Silverbrook
6,290,315 B1 9/2001 Sayama
6,290,317 B1 9/2001 Hotomi
6,291,317 B1 9/2001 Salatino et al.
6,293,639 B1 9/2001 Isamoto
6,293,642 B1 9/2001 Sano
6,293,658 B1 9/2001 Silverbrook
6,294,101 B1 9/2001 Silverbrook
6,296,340 B1 10/2001 Tajika et al.
6,296,346 B1 10/2001 Seo et al.
6,299,272 B1 10/2001 Baker et al.
6,299,289 B1 10/2001 Silverbrook
6,299,300 B1 10/2001 Silverbrook
6,299,786 B1 10/2001 Silverbrook
6,303,042 B1 10/2001 Hawkins et al.
6,305,773 B1 10/2001 Burr et al.
6,305,788 B1 10/2001 Silverbrook
6,305,791 B1 10/2001 Hotomi et al.
6,306,671 B1 10/2001 Silverbrook
6,309,048 B1 10/2001 Silverbrook
6,309,054 B1 10/2001 Kawamura et al.
6,312,076 B1 11/2001 Taki et al.
6,312,096 B1 11/2001 Koitabashi et al.
6,312,114 B1 11/2001 Silverbrook
6,312,615 B1 11/2001 Silverbrook
6,315,399 B1 11/2001 Silverbrook
6,315,914 B1 11/2001 Silverbrook
6,318,849 B1 11/2001 Silverbrook
6,322,194 B1 11/2001 Silverbrook
6,322,195 B1 11/2001 Silverbrook
6,328,395 B1 12/2001 Kitahara et al.
6,328,397 B1 12/2001 Shimizu et al.
6,328,398 B1 12/2001 Chang
6,328,399 B1 12/2001 Wen
6,328,402 B1 12/2001 Hotomi
6,328,417 B1 12/2001 Silverbrook
6,328,425 B1 12/2001 Silverbrook
6,328,431 B1 12/2001 Silverbrook
6,331,040 B1 12/2001 Yonekubo et al.
6,331,258 B1 12/2001 Silverbrook
6,336,715 B1 1/2002 Hotomi et al.
6,338,542 B1 1/2002 Fujimori
6,338,548 B1 1/2002 Silverbrook
6,340,222 B1 1/2002 Silverbrook
6,345,424 B1 2/2002 Hasegawa
6,345,880 B1 2/2002 DeBoer et al.
6,350,003 B1 2/2002 Ishikawa
6,350,019 B1 2/2002 Shingai et al.
6,352,328 B1 3/2002 Wen et al.
6,352,330 B1 3/2002 Lubinsky et al.
6,352,335 B1 3/2002 Koyama et al.
6,352,337 B1 3/2002 Sharma
6,352,814 B1 3/2002 McCullough et al.
6,354,686 B1 3/2002 Tanaka et al.
6,357,846 B1 3/2002 Kitahara
6,364,444 B1 4/2002 Ota
6,364,459 B1 4/2002 Sharma et al.
6,371,587 B1 4/2002 Chang
6,378,971 B1 4/2002 Tamura et al.
6,378,972 B1 4/2002 Akiyama et al.
6,378,973 B1 4/2002 Kubota et al.
6,378,989 B1 4/2002 Silverbrook
6,378,996 B1 4/2002 Shimada et al.
6,382,753 B1 5/2002 Teramae et al.
6,382,754 B1 5/2002 Morikoshi et al.
6,382,767 B1 5/2002 Greive
6,382,779 B1 5/2002 Silverbrook
6,382,782 B1 5/2002 Anagnostopoulos et al.
6,383,833 B1 5/2002 Silverbrook
6,386,664 B1 5/2002 Hosono et al.
6,386,679 B1 5/2002 Yang et al.
6,393,980 B2 5/2002 Simons
6,394,570 B1 5/2002 Inada
6,394,581 B1 5/2002 Silverbrook
6,398,331 B1 6/2002 Asaka et al.
6,398,344 B1 6/2002 Silverbrook
6,398,348 B1 6/2002 Haluzak et al.
6,402,278 B1 6/2002 Temple
6,402,282 B1 6/2002 Webb
6,402,300 B1 6/2002 Silverbrook
6,402,303 B1 6/2002 Sumi
6,406,129 B1 6/2002 Silverbrook
6,406,607 B1 6/2002 Hirsh et al.
6,409,295 B1 6/2002 Norigoe
6,409,316 B1 6/2002 Clark et al.
6,409,323 B1 6/2002 Silverbrook
6,412,908 B2 7/2002 Silverbrook
6,412,912 B2 7/2002 Silverbrook
6,412,914 B1 7/2002 Silverbrook
6,412,925 B1 7/2002 Takahashi
6,413,700 B1 7/2002 Hallman
6,416,149 B2 7/2002 Takahashi
6,416,168 B1 7/2002 Silverbrook
6,416,932 B1 7/2002 Ray et al.
6,419,337 B2 7/2002 Sayama
6,419,339 B2 7/2002 Takahashi
6,420,196 B1 7/2002 Silverbrook
6,422,677 B1 7/2002 Deshpande et al.
6,425,651 B1 7/2002 Silverbrook
6,425,661 B1 7/2002 Silverbrook et al.
6,425,971 B1 7/2002 Silverbrook
6,428,133 B1 8/2002 Silverbrook
6,428,134 B1 8/2002 Clark et al.
6,428,135 B1 8/2002 Lubinsky et al.
6,428,137 B1 8/2002 Iwaishi et al.
6,428,138 B1 8/2002 Asauchi et al.
6,428,146 B1 8/2002 Sharma et al.
6,428,147 B2 8/2002 Silverbrook
6,431,674 B2 8/2002 Suzuki et al.
6,431,675 B1 8/2002 Chang
6,431,676 B2 8/2002 Asauchi et al.
6,435,666 B1 8/2002 Trauernicht et al.
6,439,687 B1 8/2002 Inoue
6,439,695 B2 8/2002 Silverbrook
6,439,699 B1 8/2002 Silverbrook
6,439,701 B1 8/2002 Taneya et al.
6,439,703 B1 8/2002 Anagnostopoulos et al.
6,439,704 B1 8/2002 Silverbrook
6,443,547 B1 9/2002 Takahashi et al.
6,450,602 B1 9/2002 Lubinsky et al.
6,450,603 B1 9/2002 Chang
6,450,615 B2 9/2002 Kojima et al.
6,450,619 B1 9/2002 Anagnostopoulos et al.
6,450,627 B1 9/2002 Moynihan et al.
6,450,628 B1 9/2002 Jeanmaire et al.
6,451,216 B1 9/2002 Silverbrook
6,453,526 B2 9/2002 Lorraine et al.
6,454,396 B2 9/2002 Silverbrook
6,457,795 B1 10/2002 Silverbrook
6,457,807 B1 10/2002 Hawkins et al.
6,460,778 B1 10/2002 Silverbrook
6,460,959 B1 10/2002 Momose et al.
6,460,960 B1 10/2002 Mitsuhashi
6,463,656 B1 10/2002 Debesis et al.
6,464,315 B1 10/2002 Otokita et al.
6,467,865 B1 10/2002 Iwamura et al.
6,467,885 B2 10/2002 Tanaka

(56) References Cited

U.S. PATENT DOCUMENTS 6,471,316 B1 * 10/2002 Seto ..... B41J 2/04581 347/10
6,471,336 B2 10/2002 Silverbrook
6,474,762 B2 11/2002 Taki et al.
6,474,781 B1 11/2002 Jeanmaire
6,474,789 B1 11/2002 Ishinaga et al.
6,474,794 B1 11/2002 Anagnostopoulos et al.
6,474,795 B1 11/2002 Lebens et al.
6,478,395 B2 11/2002 Tanaka et al.
6,481,835 B2 11/2002 Hawkins et al.
6,485,123 B2 11/2002 Silverbrook
6,485,130 B2 11/2002 DeLouise et al.
6,485,133 B1 11/2002 Teramac et al.
6,488,349 B1 12/2002 Matsuo et al.
6,488,361 B2 12/2002 Silverbrook
6,488,367 B1 12/2002 Debesis et al.
6,491,362 B1 12/2002 Jeanmaire
6,491,376 B2 12/2002 Trauernicht et al.
6,491,385 B2 12/2002 Anagnostopoulos et al.
6,491,833 B1 12/2002 Silverbrook
6,494,554 B1 12/2002 Horri et al.
6,494,555 B1 12/2002 Ishikawa
6,494,556 B1 * 12/2002 Sayama et al. ..... 347/11
6,494,566 B1 12/2002 Kishino et al.
6,497,019 B1 12/2002 Yun
6,499,820 B2 12/2002 Taki
6,502,306 B2 1/2003 Silverbrook
6,502,914 B2 1/2003 Hosono et al.
6,502,925 B2 1/2003 Anagnostopoulos et al.
6,503,408 B2 1/2003 Silverbrook
6,504,701 B1 1/2003 Takamura et al.
6,505,922 B2 1/2003 Hawkins et al.
6,507,099 B1 1/2003 Silverbrook
6,508,532 B1 1/2003 Hawkins et al.
6,508,543 B2 1/2003 Hawkins et al.
6,508,947 B2 1/2003 Gulvin et al.
6,513,894 B1 2/2003 Chen et al.
6,513,903 B2 2/2003 Sharma et al.
6,513,908 B2 2/2003 Silverbrook
6,517,176 B1 2/2003 Chaug
6,517,178 B1 2/2003 Yamamoto et al.
6,517,267 B1 2/2003 Otsuki
6,521,513 B1 2/2003 Lebens et al.
6,523,923 B2 2/2003 Sekiguchi
6,526,658 B1 3/2003 Silverbrook
6,527,354 B2 3/2003 Takahashi
6,527,357 B2 3/2003 Sharma et al.
6,527,365 B1 3/2003 Silverbrook
6,530,653 B2 3/2003 Le et al.
6,533,378 B2 3/2003 Ishikawa
6,533,390 B1 3/2003 Silverbrook
6,536,874 B1 3/2003 Silverbrook
6,536,883 B2 3/2003 Hawkins et al.
6,537,735 B1 3/2003 McCullough et al.
6,540,319 B1 4/2003 Silverbrook
6,540,332 B2 4/2003 Silverbrook
6,540,338 B2 4/2003 Takahashi et al.
6,546,628 B2 4/2003 Silverbrook
6,547,364 B2 4/2003 Silverbrook
6,547,371 B2 4/2003 Silverbrook
6,550,895 B1 4/2003 Silverbrook
6,553,651 B2 4/2003 Reznik et al.
6,554,410 B2 4/2003 Jeanmaire et al.
6,557,967 B1 5/2003 Lee
6,557,978 B2 5/2003 Silverbrook
6,561,608 B1 5/2003 Yamamoto et al.
6,561,614 B1 5/2003 Therien et al.
6,561,625 B2 5/2003 Maeng et al.
6,565,193 B1 5/2003 Silverbrook et al.
6,565,762 B1 5/2003 Silverbrook
6,566,858 B1 5/2003 Silverbrook et al.
6,568,797 B2 5/2003 Yamauchi et al.
6,572,210 B2 6/2003 Chaug
6,572,215 B2 6/2003 Sharma
6,572,715 B2 6/2003 Komine et al.
6,575,544 B2 6/2003 Iriguchi
6,575,549 B1 6/2003 Silverbrook
6,578,245 B1 6/2003 Chatterjee et al.
6,581,258 B2 6/2003 Yoneda et al.
6,582,043 B2 6/2003 Ishizaki
6,582,059 B2 6/2003 Silverbrook
6,588,882 B2 7/2003 Silverbrook
6,588,884 B1 7/2003 Furlani et al.
6,588,888 B2 7/2003 Jeanmaire et al.
6,588,889 B2 7/2003 Jeanmaire
6,588,890 B1 7/2003 Furlani et al.
6,588,952 B1 7/2003 Silverbrook et al.
6,594,898 B1 7/2003 Yun
6,595,617 B2 7/2003 Sharma et al.
6,595,620 B2 7/2003 Kubota et al.
6,599,757 B1 7/2003 Murai
6,629,739 B2 10/2003 Korol
6,629,756 B2 10/2003 Wang
6,641,744 B1 11/2003 Kawamura et al.
6,644,767 B2 11/2003 Silverbrook
6,655,795 B2 12/2003 Wachtel
6,659,583 B2 12/2003 Fujimori
6,672,704 B2 1/2004 Katakura et al.
6,682,170 B2 1/2004 Hotomi et al.
6,685,293 B2 2/2004 Junhua
6,755,511 B1 6/2004 Moynihan et al.
6,767,085 B2 7/2004 Murai
6,779,866 B2 8/2004 Junhua et al.
6,789,866 B2 9/2004 Sekiya et al.
6,793,311 B2 9/2004 Baba et al.
6,851,780 B2 2/2005 Fujimura et al.
6,857,715 B2 2/2005 Darling
6,896,346 B2 5/2005 Trauernicht et al.
6,902,248 B2 6/2005 Koguchi
6,923,520 B2 8/2005 Oikawa et al.
7,011,396 B2 3/2006 Moynihan et al.
7,014,297 B2 3/2006 Miki et al.
7,052,117 B2 5/2006 Bibl et al.
7,195,327 B2 3/2007 Kitami et al.
7,281,778 B2 10/2007 Hasenbein et al.
7,303,264 B2 12/2007 Bibl et al.
7,478,899 B2 1/2009 Moynihan et al.
8,162,466 B2 4/2012 Bibl et al.
8,349,405 B2 1/2013 Ito et al.
8,459,768 B2 6/2013 Hasenbein et al.
8,491,100 B2 7/2013 Moynihan et al.
8,708,441 B2 * 4/2014 Hoisington ..... B41J 2/04581 347/10
8,789,904 B2 7/2014 Avery et al.
2001/0001458 A1 5/2001 Hashizume et al.
2001/0002135 A1 5/2001 Milligan et al.
2001/0002836 A1 6/2001 Tanaka et al.
2001/0007460 A1 7/2001 Fujii et al.
2001/0015001 A1 8/2001 Hashizume
2001/0022596 A1 9/2001 Korol
2001/0023523 A1 9/2001 Kubby et al.
2001/0026294 A1 10/2001 Takahashi
2001/0028378 A1 10/2001 Lee et al.
2001/0032382 A1 10/2001 Lorraine et al.
2001/0033313 A1 10/2001 Ohno et al.
2001/0038404 A1 11/2001 Kitahara et al.
2001/0043241 A1 11/2001 Takahashi et al.
2002/0008738 A1 1/2002 Lee et al.
2002/0018082 A1 2/2002 Hosono et al.
2002/0018083 A1 2/2002 Sayama
2002/0018085 A1 2/2002 Asauchi et al.
2002/0018105 A1 2/2002 Usui et al.
2002/0024546 A1 2/2002 Chang
2002/0033644 A1 3/2002 Takamura et al.
2002/0033852 A1 3/2002 Chang
2002/0036666 A1 3/2002 Taki
2002/0036669 A1 3/2002 Hosono et al.
2002/0039117 A1 4/2002 Oikawa
2002/0041315 A1 4/2002 Kubota et al.
2002/0051039 A1 5/2002 Moynihan et al.
2002/0051042 A1 5/2002 Takagi et al.
2002/0054311 A1 5/2002 Kubo
2002/0057303 A1 5/2002 Takahashi et al.
2002/0060724 A1 5/2002 Le et al.

(56) References Cited

U.S. PATENT DOCUMENTS

| | | | |
|---|---|---|---|
| 2002/0070992 | A1 | 6/2002 | Fukano |
| 2002/0075360 | A1 | 6/2002 | Maeng et al. |
| 2002/0080202 | A1 | 6/2002 | Sekiguchi |
| 2002/0085065 | A1 | 7/2002 | Shimada et al. |
| 2002/0089558 | A1 | 7/2002 | Suzuki et al. |
| 2002/0096488 | A1 | 7/2002 | Gulvin et al. |
| 2002/0096489 | A1 | 7/2002 | Lee et al. |
| 2002/0097303 | A1 | 7/2002 | Gulvin et al. |
| 2002/0101464 | A1 | 8/2002 | Iriguchi |
| 2002/0109192 | A1 | 8/2002 | Hogyoku |
| 2002/0122085 | A1 | 9/2002 | Chaug |
| 2002/0122100 | A1 | 9/2002 | Nordstrom et al. |
| 2002/0129478 | A1 | 9/2002 | Kishima |
| 2002/0139235 | A1 | 10/2002 | Nordin et al. |
| 2002/0145637 | A1 | 10/2002 | Umeda et al. |
| 2002/0158926 | A1 | 10/2002 | Fukano |
| 2002/0158927 | A1 | 10/2002 | Kojima |
| 2002/0167559 | A1 | 11/2002 | Hosono et al. |
| 2002/0184907 | A1 | 12/2002 | Vaiyapuri et al. |
| 2003/0016272 | A1 | 1/2003 | Anagnostopoulos et al. |
| 2003/0016275 | A1 | 1/2003 | Jeanmaire et al. |
| 2003/0058309 | A1 | 3/2003 | Haluzak et al. |
| 2003/0067500 | A1 | 4/2003 | Fujimura et al. |
| 2003/0071138 | A1 | 4/2003 | Usuda |
| 2003/0071869 | A1 | 4/2003 | Baba et al. |
| 2003/0081025 | A1 | 5/2003 | Yonekubo |
| 2003/0081040 | A1 | 5/2003 | Therien et al. |
| 2003/0081073 | A1 | 5/2003 | Chen et al. |
| 2003/0103095 | A1 | 6/2003 | Imai |
| 2003/0107617 | A1 | 6/2003 | Okuda |
| 2003/0107622 | A1 | 6/2003 | Sugahara |
| 2003/0112297 | A1 | 6/2003 | Hiratsuka et al. |
| 2003/0117465 | A1 | 6/2003 | Chwalek et al. |
| 2003/0122885 | A1 | 7/2003 | Kobayashi |
| 2003/0122888 | A1 | 7/2003 | Baba |
| 2003/0122889 | A1 | 7/2003 | Okuda |
| 2003/0131475 | A1 | 7/2003 | Conta |
| 2003/0132823 | A1 | 7/2003 | Hyman et al. |
| 2003/0136002 | A1 | 7/2003 | Nishikawa et al. |
| 2003/0156157 | A1 | 8/2003 | Suzuki et al. |
| 2003/0156158 | A1 | 8/2003 | Hirota et al. |
| 2003/0156159 | A1 | 8/2003 | Kobayashi |
| 2003/0156162 | A1 | 8/2003 | Hirota et al. |
| 2003/0227497 | A1 | 12/2003 | Tamura |
| 2003/0234826 | A1 | 12/2003 | Hosono et al. |
| 2004/0004649 | A1 | 1/2004 | Bibl et al. |
| 2004/0027405 | A1 | 2/2004 | Stoessel et al. |
| 2004/0032467 | A1 | 2/2004 | Usui |
| 2004/0085374 | A1 | 5/2004 | Berger et al. |
| 2004/0113960 | A1 | 6/2004 | Usui |
| 2004/0155915 | A1 | 8/2004 | Kitami et al. |
| 2004/0207671 | A1 | 10/2004 | Kusunoki et al. |
| 2005/0035986 | A1 | 2/2005 | Iwao et al. |
| 2005/0052492 | A1* | 3/2005 | Ikeda ..... B41J 2/04541 347/40 |
| 2005/0093903 | A1 | 5/2005 | Darling |
| 2005/0200640 | A1 | 9/2005 | Hasenbein et al. |
| 2005/0280675 | A1 | 12/2005 | Bibl et al. |
| 2006/0181557 | A1 | 8/2006 | Hoisington et al. |
| 2007/0008356 | A1 | 1/2007 | Katoh |
| 2008/0074451 | A1 | 3/2008 | Hasenbein et al. |
| 2009/0079801 | A1 | 3/2009 | Moynihan et al. |
| 2010/0039479 | A1 | 2/2010 | Bibl et al. |

FOREIGN PATENT DOCUMENTS

| | | | |
|---|---|---|---|
| EP | 0 413 340 | A1 | 2/1991 |
| EP | 0 486 256 | | 11/1991 |
| EP | 0 422 870 | | 1/1995 |
| EP | 0 667 239 | | 8/1995 |
| EP | 0 709 200 | A1 | 5/1996 |
| EP | 0 736 915 | A1 | 10/1996 |
| EP | 0 719 642 | | 12/1996 |
| EP | 0 839 655 | | 5/1998 |
| EP | 0 855 273 | | 7/1998 |
| EP | 0 916 497 | | 5/1999 |
| EP | 0 916 500 | | 5/1999 |
| EP | 0 949 079 | | 10/1999 |
| EP | 0 783 410 | | 1/2000 |
| EP | 0 969 530 | | 1/2000 |
| EP | 0 979 732 | | 2/2000 |
| EP | 0 980 103 | | 2/2000 |
| EP | 0 867 289 | | 3/2000 |
| EP | 0 985 534 | | 3/2000 |
| EP | 1 004 441 | | 5/2000 |
| EP | 1 123 806 | | 8/2001 |
| EP | 1 138 492 | | 10/2001 |
| EP | 0 963 296 | | 1/2002 |
| EP | 1 011 975 | | 4/2002 |
| EP | 0 983 145 | | 9/2002 |
| EP | 1 241 009 | A2 | 9/2002 |
| EP | 0 973 644 | | 1/2003 |
| EP | 1 284 188 | A2 | 2/2003 |
| EP | 1 321 294 | A2 | 6/2003 |
| EP | 1 116 591 | | 5/2006 |
| EP | 1 836 056 | | 9/2007 |
| JP | 59-143652 | | 8/1984 |
| JP | 60159064 | | 8/1985 |
| JP | 02-080252 | | 3/1990 |
| JP | 2-0175256 | | 7/1990 |
| JP | 02184447 | | 7/1990 |
| JP | 05169654 | | 7/1993 |
| JP | 06-132756 | | 5/1994 |
| JP | 06-137438 | | 5/1994 |
| JP | 61-37438 | | 5/1994 |
| JP | 06-198876 | | 7/1994 |
| JP | 06-305141 | | 11/1994 |
| JP | 07241989 | | 9/1995 |
| JP | 8506540 | | 7/1996 |
| JP | 09-039232 | | 2/1997 |
| JP | 09-039234 | | 2/1997 |
| JP | 09-039238 | | 2/1997 |
| JP | 09-223831 | | 8/1997 |
| JP | 9272202 | | 10/1997 |
| JP | 9314863 | | 12/1997 |
| JP | 63-071355 | | 3/1998 |
| JP | 10058674 | | 3/1998 |
| JP | 10-119260 | | 5/1998 |
| JP | H10-119260 | | 5/1998 |
| JP | 10-264385 | | 10/1998 |
| JP | 11-058737 | | 3/1999 |
| JP | 11-216880 | | 8/1999 |
| JP | 11-227203 | | 8/1999 |
| JP | 11-334088 | | 12/1999 |
| JP | 2000-516872 | | 12/2000 |
| JP | 2001010040 | | 1/2001 |
| JP | 2001-088294 | | 4/2001 |
| JP | 2001-260355 | | 9/2001 |
| JP | 2001-518030 | | 10/2001 |
| JP | 2001-334674 | | 12/2001 |
| JP | 2002-079668 | | 3/2002 |
| JP | 2002-173375 | | 6/2002 |
| JP | 2002-187271 | | 7/2002 |
| JP | 2003-175601 | | 6/2003 |
| JP | 2004-154962 | | 6/2004 |
| JP | 2004-188990 | | 7/2004 |
| JP | 2004-275956 | | 10/2004 |
| JP | 2004-284283 | | 10/2004 |
| JP | 2005-238728 | | 9/2005 |
| JP | 2007-549599 | | 12/2005 |
| JP | 2006-75660 | | 3/2006 |
| JP | 2004-275956 | | 10/2011 |
| JP | 2004-284283 | | 10/2011 |
| KR | 2007-0087223 | | 8/2007 |
| TW | 200304014 | | 9/2003 |
| WO | WO 98/42517 | | 10/1998 |
| WO | WO00/21755 | | 4/2000 |
| WO | WO02/098576 | | 12/2002 |
| WO | WO03/026897 | | 4/2003 |
| WO | WO2005/089324 | | 9/2005 |

(56) References Cited

FOREIGN PATENT DOCUMENTS

| | | |
|---|---|---|
| WO | WO2006/009941 | 1/2006 |
| WO | WO2006/074016 | 7/2006 |

OTHER PUBLICATIONS

Abstract U.S. Appl. No. 08/884,244, filed Jun. 30, 1997.
Abstract USSN 115,201, filed on Jul. 15, 1998, 1 page.
Abstract USSN 116,014, filed on Jul. 15, 1998, 1 page.
Abstract USSN 143,058, filed on Aug. 28, 1998, 1 page.
Abstract USSN 143,059, filed on Aug. 28, 1998, 1 page.
Abstract USSN 143,501, filed on Aug. 28, 1998, 1 page.
Abstract USSN 225,179, filed on Jan. 4, 1999, 1 page.
Abstract USSN 920,496, filed on Aug. 29, 1997, 1 page.
Abstract USSN 924,721, filed on Aug. 29, 1997, 1 page.
Balfrey Precision Products, Machine Tools, Balfrey Precision Inc, 1998, 3 pages.
English translation of Office Action from co-pending Japanese application No. 2007-504034, issued May 6, 2011, 3 pages.
European Search Report from European application No. 06 01 5045.5, dated Oct. 24, 2006.
European Supplemental Search Report for Application No. EP 05 85 5801, dated Nov. 27, 2009, 8 pages.
European Supplemental Search Report from EP application No. 05725642.2 dated Mar. 26, 2008.
Examination Report from Australian application No. 2003247683, dated Apr. 24, 2007.
Examination Report from Australian application No. 2003247683, dated Mar. 26, 2008.
Examination Report from European application No. 06 01 5045.5, dated Mar. 3, 2008.
Communication Pursuant to Article 94(3) EPC, Mar. 11, 2009, European Patent Office (office action issued in co-pending European application No. 03763081.1).
Office Action, May 8, 2009, Chinese Patent Office (issued in co-pending Chinese application No. 200580014141.8).
Extended European Search Report dated Jun. 26, 2009, issued in co-pending European application No. 09161286.1.
Notice of Reasons for Rejection, Jul. 3, 2009, Japanese Patent Office (office action issued in co-pending Japanese application No. 2007-250120).
Notice of Reasons for Rejection, May 15, 2009, Japanese Patent Office (office action issued in co-pending Japanese application No. 2004-519728).
First Office Action, dated Jun. 19, 2009, for Chinese application No. 200710161961.0.
Fromm, J.E., "Numerical calculation of the fluid dynamics of drop-on-demand jets," *IBM J. Res. Develop.,* 28(3):322-333 (1984).
International Preliminary Examination Report for Application No. PCT/US00/41084, dated Dec. 28, 2001, 8 pages.
International Preliminary Report on Patentability from PCT Application No. PCT/US2003/20730 dated Jul. 27, 2005, 5 pages (Aug. 26, 2005?????).
International Preliminary Report on Patentability from PCT Application No. PCT/US2005/008606 dated Sep. 19, 2006, 8 pages.
International Preliminary Report on Patentability from PCT Application No. PCT/US2005/047302 dated Jul. 3, 2007, 6 pages.
International Preliminary Report on Patentability from PCT Application No. PCT/US2007/066159 dated Oct. 23, 2008, 11 pages.
International Search Report for Application No. PCT/US00/41084, dated Apr. 18, 2001, 3 pages.
International Search Report from PCT Application No. PCT/US2005/008606 dated Apr. 20, 2006, 18 pages.
International Search Report from PCT Application No. PCT/US2005/047302 dated Dec. 19, 2006, 13 pages.
International Search Report from PCT Application No. PCT/US2007/066159 dated Jun. 10, 2008, 16 pages.
International Search Report, from PCT Application No. PCT/US03/20730, dated Mar. 25, 2004, 2 pages.
Korean Office Action, with English Translation, Application No. 10-2013-7013939, mailed Aug. 26, 2013, 6 pages.
Machine Language Translation of JP 09-039232.
Machine Language Translation of JP 10-264385.
Microfabrication and Micromachining, 35 pages Available Web Site: http://mems.cwru.edu/shortcourse/partI_2.html.
Mills et al., "Drop-on-demand ink jet technology for color printing," *SID 82 Digest,* 13:156-157 (1982).
Office action dated Aug. 2, 2011 issued in Japanese application No. 2009-505550.
Office action dated Dec. 22, 2011 issue in Korean application No. 2006-7021425.
Office Action dated Jan. 31, 2012 issued on Japanese application No. 2011-062638.
Office action dated Nov. 1, 2011 issued in Japanese application No. 2007-549599.
Office Action for co-pending U.S. Appl. No. 11/321,941 dated Aug. 29, 2011.
Office Action for Japanese Application No. 2011-062638 dated Jan. 27, 2012.
Office Action from Canadian application No. 2386737, dated Jul. 11, 2007.
Office Action from Canadian application No. 2386737, dated Jun. 22, 2006.
Office Action from Canadian application No. 2620776, dated Mar. 11, 2009.
Office Action from Chinese application No. 038199505, dated Sep. 8, 2006. (Sep. 23, 2006????).
Office Action from Chinese application No. 200580014141.8, dated Jun. 24, 2008.
Office Action from Chinese application No. 200580045647.5 dated Feb. 2, 2009.
Office Action from corresponding CN application No. 200780013181.X, mailed Mar. 13, 2012, with English translation, 9 pages.
Office Action from corresponding JP application No. 2007-504034, mailed Apr. 24, 2012, with English Summary, 6 pages.
Office Action from corresponding JP application No. 2009-505550, mailed Jul. 31, 2012 with English translation, 6 pages.
Office Action from corresponding KR application No. 10-2007-7017258, dated Jun. 28, 2012, with English translation, 10 pages.
Office action from corresponding U.S. Appl. No. 11/321,941, mailed Apr. 4, 2012.
Office Action from European application No. 06 01 5045.5, dated Feb. 7, 2008.
Office Action from Japanese Application No. 2001-527993, dated Oct. 27, 2009, English translation included, 7 pages.
Office Action from Japanese application No. 2004-519728, dated Jul. 7, 2008.
Office Action from Korean application No. 10-2004-7021621, dated May 18, 2007.
Office Action from Korean application No. 10-2004-7021621, dated Oct. 27, 2006.
Office Action from Korean application No. 10-2007-7021241, dated Mar. 17, 2009.
Office Action in Japanese Application No. 2011-062638, dated Dec. 18, 2012, 4 pages.
Office Action received in co-pending European application No. 05725642.2 dated Apr. 6, 2010.
Office Action received in co-pending European application No. 05855801.6 dated Mar. 26, 2010.
Office Action received in co-pending Japanese application No. 2007-504034 dated Sep. 21, 2010.
Office Action received in co-pending Japanese application No. 2007-549599 dated Feb. 11, 2011.
Office Action received in co-pending Taiwan application 94107480 dated Jul. 7, 2010.
Office Action received in co-pending Taiwan application No. 94107480 dated Feb. 21, 2011.
Office Action received in co-pending U.S. Appl. No. 11/279,496 dated Apr. 29, 2010.
Office Action received in co-pending U.S. Appl. No. 11/321,941 dated Jan. 25, 2010.

(56) References Cited

OTHER PUBLICATIONS

Office Action received in co-pending U.S. Appl. No. 11/321,941 dated Jun. 10, 2010.
Office Action received in European application No. 07760260.5 dated Feb. 4, 2011.
Office Action, dated Aug. 14, 2009, Chinese Patent Office (issued in co-pending Chinese application No. 200580045647.5).
Transaction history for U.S. Appl. No. 09/412,827 (issued as U.S. Pat. No. 6,755,511).
Transaction history for U.S. Appl. No. 10/189,947 (issued as U.S. Pat. No. 7,052,117).
Transaction history for U.S. Appl. No. 10/800,467 (issued as U.S. Pat. No. 7,281,778).
Transaction history for U.S. Appl. No. 10/879,689 (issued as U.S. Pat. No. 7,011,396).
Transaction history for U.S. Appl. No. 11/213,596 (published as US 2005/0280675).
Transaction history for U.S. Appl. No. 11/214,681 (issued as U.S. Pat. No. 7,303,264).
Transaction history for U.S. Appl. No. 11/336,423 (issued as U.S. Pat. No. 7,478,899).
Transaction history for U.S. Appl. No. 11/864,250 (published as US 2008/0074451).
Transaction history for U.S. Appl. No. 12/326,615 (published as US 2009/0079801).
Partial International Search Report, International Application No. PCT/US03/20730, Oct. 20, 2003, 5 pages (Annex to Invitation to Pay Additional Fees).
Patent Numbers from the result set of various DIALOG searches of U.S. patent publications. Although the scope of the various searches varied, the searches were directed to identifying patent publications related to printing grey scale using ink jet technology.
Pending claims from US2005/0280675.
Pending claims from US2008/0074451 (U.S. Appl. No. 11/864,250).
Pending claims from US2009/0079801.
U.S. Appl. No. 10/189,947, filed Jul. 3, 2003.
U.S. Appl. No. 10/800,467, filed Mar. 15, 2004.
U.S. Appl. No. 11/279,496, filed Apr. 12, 2006.
U.S. Appl. No. 11/321,941, filed Aug. 31, 2009.
U.S. Appl. No. 11/864,250, filed Sep. 28, 2007.
U.S. Appl. No. 60/640,538 filed Dec. 30, 2004.
U.S. Appl. No. 09/412,827, Edward R. Moynihan et al., filed Oct. 5, 1999; Application; Pending Claims.
Office Action issued in European Application No. 05855801.6 dated Jan. 25, 2013, 4.
Office Action received in co-pending Korean application No. 10-2007-7017258, dated Feb. 27, 2013, 6 pages.

* cited by examiner

INK JET PRINTING

CROSS-REFERENCE TO RELATED APPLICATIONS

This application is a continuation application and claims priority under 35 U.S.C. §120 to U.S. patent application Ser. No. 11/321,941, entitled "INK JET PRINTING," filed on Dec. 29, 2005, now U.S. Pat. No. 8,708,441, which claims benefit under U.S.C. §119(e) to Provisional Application No. 60/640,538, entitled "INK JET PRINTING," filed on Dec. 30, 2004. The entire contents of both applications are incorporated herein by reference.

TECHNICAL FIELD

This disclosure relates to ink jet printing.

BACKGROUND

Inkjet printers are one type of apparatus employing droplet ejection devices. In one type of inkjet printer, ink drops are delivered from a plurality of linear inkjet print head devices oriented perpendicular to the direction of travel of the substrate being printed. Each print head device includes a plurality of droplet ejection devices formed in a monolithic body that defines a plurality of pumping chambers (one for each individual droplet ejection device) in an upper surface and has a flat piezoelectric actuator covering each pumping chamber. Each individual droplet ejection device is activated by a voltage pulse to the piezoelectric actuator that distorts the shape of the piezoelectric actuator and discharges a droplet at the desired time in synchronism with the movement of the substrate past the print head device.

Each individual droplet ejection device is independently addressable and can be activated on demand in proper timing with the other droplet ejection devices to generate an image. Printing occurs in print cycles. In each print cycle, a fire pulse (e.g., 10-150 volts) is applied to all of the droplet ejection devices at the same time, and enabling signals are sent to only the individual droplet ejection devices that are to jet ink in that print cycle.

SUMMARY

In general, in one aspect, the invention features a method of driving an inkjet module having a plurality of ink jets. The method includes applying a voltage waveform to the inkjet module, the voltage waveform including a first pulse and a second pulse, activating one or more of the ink jets contemporaneously to applying the first pulse, wherein each activated ink jet ejects a fluid droplet in response to the first pulse, and activating all of the ink jets contemporaneously to applying the second pulse without ejecting a droplet.

Embodiments of this aspect of the invention may include one or more of the following features. Each ink jet comprises a piezoelectric transducer. Activating an ink jet causes the voltage waveform to be applied to the piezoelectric transducer for that ink jet. Activating all of the ink jets contemporaneously causes a fluid meniscus in each ink jet to move in response to the second pulse without ejecting a droplet.

The method may further include applying additional voltage waveforms to the inkjet module, the voltage waveforms being applied with a frequency of about 2 kHz or more. The first pulse has a first period and the second pulse has a second period less than the first period. The first pulse has a first amplitude and the second pulse has a second amplitude less than the first amplitude.

In another aspect of the invention, a method of driving an inkjet module having a plurality of ink jets comprises applying a voltage waveform to an ink jet in the inkjet module each period in a jetting cycle, wherein each cycle the voltage waveform comprises a first pulse or a second pulse. The first pulse causes the ink jet to eject a fluid droplet and the second pulse causes a fluid meniscus in the ink jet to move without ejecting a droplet.

Embodiments of this aspect of the invention may include one or more of the following features. Each period of the voltage waveform includes either the first pulse or the second pulse. The second pulse is applied to the ink jet contemporaneously to applying the first pulse to other ink jets in the inkjet module. In a further aspect of the invention, a system comprises an inkjet module including a plurality of ink jets; and an electronic controller configured to deliver a voltage waveform to at least one of the ink jets in the inkjet module each period of a jetting cycle, the voltage waveform comprising a first pulse or a second pulse, the first pulse causing the ink jet to eject a fluid droplet and the second pulse causing a fluid meniscus in the ink jet to move without ejecting a droplet.

Embodiments of this aspect of the invention may include one or more of the following features. Each ink jet comprises a piezoelectric transducer. The inkjet module comprises control circuitry configured to activate the ink jets so that the electronic controller applies the drive waveform to activated ink jets but not to ink jets that are not activated. The control circuitry is configured to activate all of the ink jets contemporaneously to applying the second pulse to the inkjet module. The electronic controller is configured to deliver the same drive waveform to each activated ink jet. Alternatively, the electronic controller is configured to deliver different drive waveforms to different ink jets. In some embodiments, the inkjet module comprises 16 or more ink jets. A pulse that causes the fluid meniscus in an each ink jet to move in response to the pulse without ejecting a droplet is referred to herein as a "tickle pulse." The voltage waveform can be applied to the ink jet module periodically, corresponding to each jetting cycle of the module.

Embodiments of the method and system described above can include one or more of the following advantages. Applying a tickle pulse to each ink jet each jetting cycle can reduce the effects of fluid evaporation from a nozzle of each ink jet, and can prevent, or at least reduce, the chance that a nozzle will dry out. This can be particularly advantageous when jetting highly volatile fluids (e.g., solvent-based inks) and/or when an ink jet remains inactive for an extended period of time during operation. Increasing jet "open time" (i.e., the length of time an inactive jet remains capable of optimal jetting before drying out) can improve reliability of printheads utilizing ink jet modules, particularly during jetting operations where one or more nozzle remains inactive for an extended period.

In embodiments, tickle pulses can be applied to each jet each cycle with little (if any) modification to drive electronics. The tickle pulse can be effectuated by modifying the drive waveform and the timing of an "all on" signal, which activates all ink jets in a module.

The details of one or more embodiments of the invention are set forth in the accompanying drawings and the description below. Other features and advantages of the invention will be apparent from the description and drawings, and from the claim.

DESCRIPTION OF DRAWINGS

FIG. 3A is an example of a waveform cycle.

FIG. 3B is a logic signal for activating selected jets corresponding to the waveform cycle shown in FIG. 3A.

FIG. 3C is a logic signal for non-selected jets corresponding to the waveform cycle shown in FIG. 3A.

FIG. 4A is an example of a waveform cycle.

FIG. 4B is a logic signal for activating selected jets corresponding to the waveform cycle shown in FIG. 4A.

DETAILED DESCRIPTION

Figure 1:
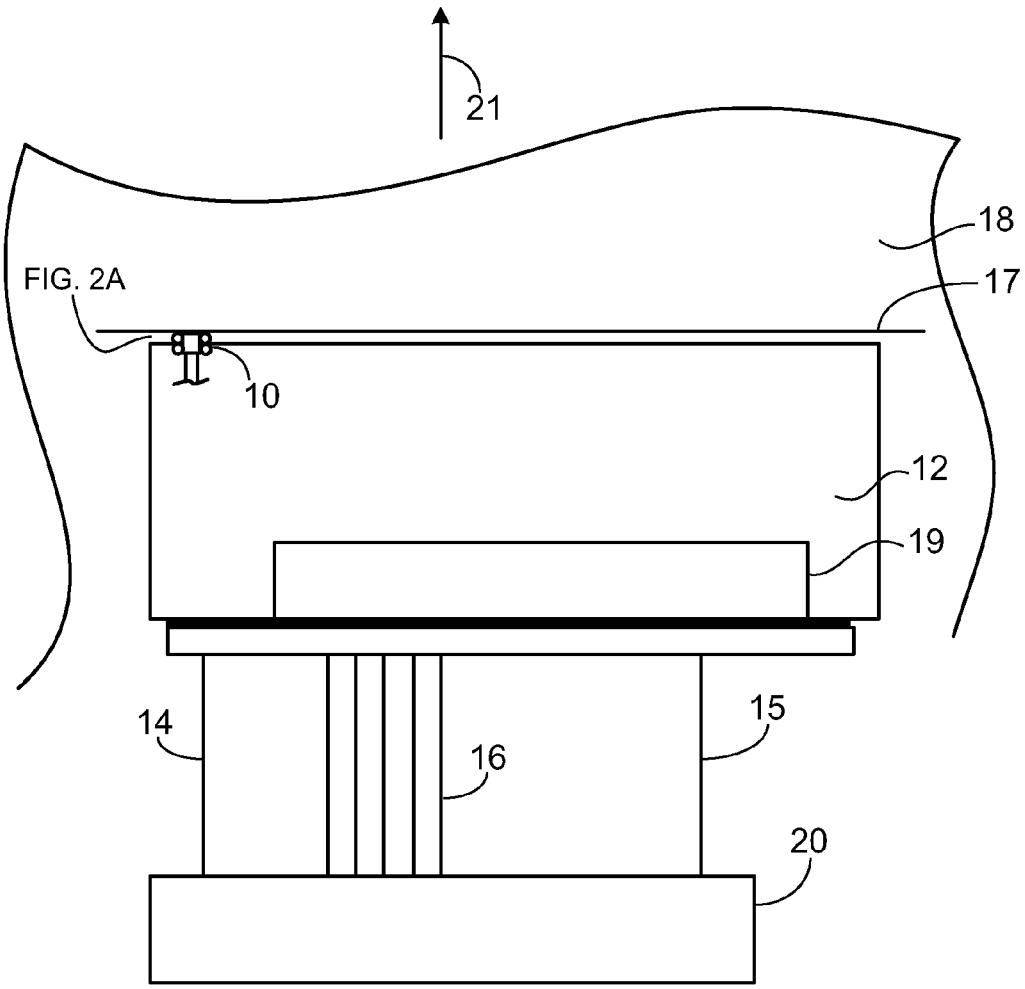
FIG. 1 is a schematic diagram of an embodiment of a printhead.

Referring to FIG. 1, an ink jet module 12 includes multiple (e.g., 16, 64, 128, 256, 512 or more) ink jets 10 (only one is shown on FIG. 1), which are driven by electrical drive pulses provided over signal lines 14 and 15 and distributed by on-board control circuitry 19 to control firing of ink jets 10. An external controller 20 supplies the drive pulses over lines 14 and 15 and provides control data and logic power and timing over additional lines 16 to on-board control circuitry 19. Ink jetted by ink jets 10 can be delivered to form one or more print lines 17 on a substrate 18 that moves relative to ink jet module 12 (e.g., in the direction indicated by arrow 21). In some embodiments, substrate 18 moves past a stationary print head module 12 in a single pass mode. Alternatively, ink jet module 12 can also move across substrate 18 in a scanning mode.

Figure 2A:
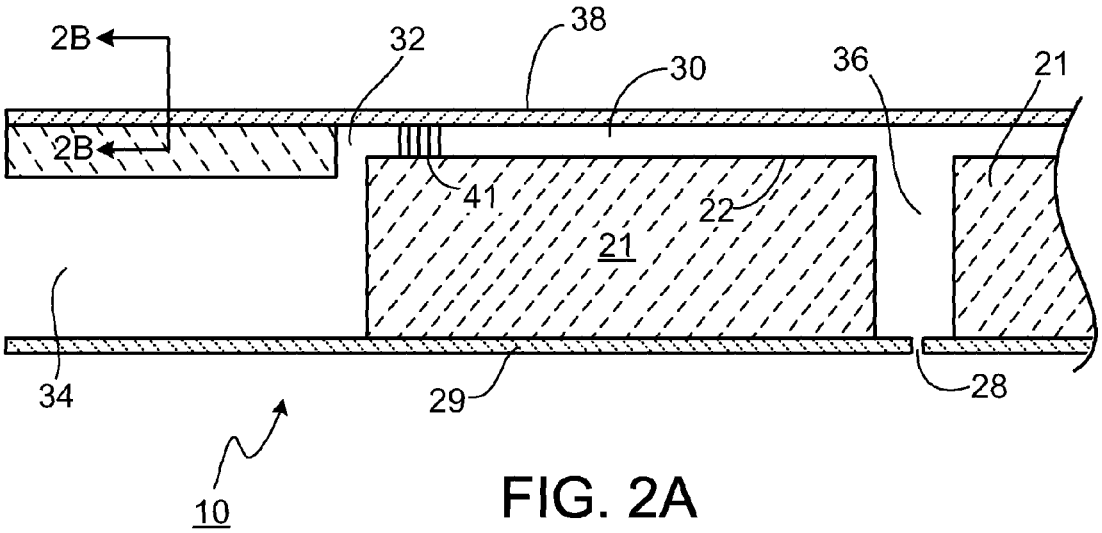
FIG. 2A is a cross-sectional view of an embodiment of an ink jet.

Referring to FIG. 2A (which is a diagrammatic vertical section), each ink jet 10 includes an elongated pumping chamber 30 in an upper face of a semiconductor block 21 of print head 12. Pumping chamber 30 extends from an inlet 32 (from a source of ink 34 along the side) to a nozzle flow path in a descender passage 36 that descends from an upper surface 22 of block 21 to a nozzle 28 opening in a lower layer 29. The nozzle size may vary as desired. For example, the nozzle can be on the order of a few microns in diameter (e.g., about 5 microns, about 8 microns, 10 microns) or can be tens or hundreds of microns in diameter (e.g., about 20 microns, 30 microns, 50 microns, 80 microns, 100 microns, 200 microns or more). A flow restriction element 41 is provided at the inlet 32 to each pumping chamber 30. In some embodiments, flow restriction element 41 includes a number of posts in inlet 32. A flat piezoelectric actuator 38 covering each pumping chamber 30 is activated by drive pulses provided from line 14, the timing of which are controlled by control signals from on-board circuitry 19. The drive pulses distort the piezoelectric actuator shape and thus vary the volume in chamber 30 drawing fluid into the chamber from the inlet and forcing ink through the descender passage 36 and out the nozzle 28. Each print cycle, multipulse drive waveforms are delivered to activated jets, causing each of those jets to eject a single droplet from its nozzle at a desired time in synchronism with the relative movement of substrate 18 past the print head device 12.

During operation, controller 20 supplies a periodic waveform to ink jet module 12. One period of the waveform can include one or more pulses. Controller 20 also provides logic signals that activate or deactivate individual ink jets. When an ink jet is activated, controller 20 applies the waveform to the ink jet's piezoelectric actuator.

Figure 2B:
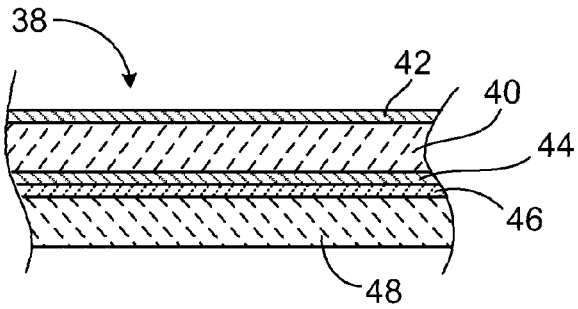
FIG. 2B is a cross-sectional view of an actuator of the ink jet shown in FIG. 2A.

Referring also to FIG. 2B, flat piezoelectric actuator 38 includes a piezoelectric layer 40 disposed between a drive electrode 42 and a ground electrode 44. Ground electrode 44 is bonded to a membrane 48 (e.g., a silica, glass or silicon membrane) by a bonding layer 46. When the ink jet is activated, the waveform generates an electric field within piezoelectric layer 40 by applying a potential difference between drive electrode 42 and ground electrode 44. Piezoelectric layer 40 distorts actuator 38 in response to the electric field, thus changing the volume of chamber 30. The volume change causes pressure waves in fluid in chamber 30. Depending on the amplitude and/or period of the waveform pulse applied to the actuator, these pressure waves can cause the ink jet to eject a droplet from its nozzle, or can excite the fluid meniscus in the nozzle without ejecting a droplet.

In general, each cycle of the periodic waveform includes a first pulse and a second pulse. The first pulse has a sufficiently large amplitude and/or period to cause an activated ink jet to eject a fluid droplet. This pulse is also referred to as an ejection pulse. The second pulse is a tickle pulse and has an amplitude and/or period insufficient to cause an activated ink jet to eject a droplet. For each cycle of the periodic waveform, controller 20 activates selected jets during the first pulse, causing each of the selected ink jets to eject a droplet. Controller 20 activates all the ink jets during the second pulse.

The second pulse causes motion of a meniscus in each jet nozzle. Where the meniscus has receded due to, e.g., evaporation of the fluid from the nozzle, the tickle pulse can restore the meniscus to the position it would assume after jetting a droplet. Accordingly, after each cycle, the position of the meniscus in each nozzle can be substantially the same, regardless of whether or not the jet was activated for that cycle.

Referring to FIG. 3A, an example of a waveform is waveform 300. Each cycle of waveform 300 includes a first pulse 310 and a second pulse 320. A cycle of waveform 300 begins at t=0. Pulse 310 begins at time $t_1$ and ends at time $t_2$. Pulse 310 has a period, $T_{310}$, equal to $t_2$-$t_1$. Pulse 320 begins at time $t_3$, some time after $t_2$, and ends at time $t_4$. Pulse 320 has a period, $T_{320}$, equal to $t_4$-$t_3$. The cycle has a period T and repeats while the ink jet module is jetting.

Pulse 310 is a bipolar pulse that includes a first trapezoidal portion of negative voltage followed by a second portion having positive voltage. The trapezoidal portion has a minimum voltage of $\beta$, which is maintained for a period. The second portion has a maximum voltage of $\alpha$, also held for a period. The voltage is then reduced to an intermediate positive voltage that is held for a period before the pulse ends.

The shape of pulse 310, $\alpha$, $\beta$, and $T_{310}$ are selected so that an activated ink jet driven by pulse 310 ejects a droplet of a predetermined volume. $\beta$ can be about −5 V or less (e.g., about −10 V or less, about −15 V or less, about −20 V or less). $\alpha$ can be about 5 V or more (about 10 V or more, about 20 V or more, about 30 V or more, about 40 V or more, about 50 V or more, about 60 V or more, about 70 V or more, about 80 V or more, about 90 V or more, about 100 V or more). In some embodiments, $\alpha$-$\beta$ can be about 30 V or more (e.g., about 40 V or more, about 50 V or more, about 60 V or more, about 70

V or more, about 80 V or more, about 90 V or more, about 100 V or more, about 110 V or more, about 120 V or more, about 130 V or more, about 140 V or more, about 150 V or more). Generally, $T_{310}$ is within a range from about 1 μs and about 100 μs (e.g., about 2 μs or more, about 5 μs or more, about 10 μs or more, about 75 μs or less, about 50 μs or less, about 40 μs or less).

Pulse 320 is a unipolar, rectangular pulse that has a maximum amplitude of γ. In general, γ and $T_{320}$ are selected so that activated ink jets driven by pulse 320 do not eject droplets, but still experience a pressure wave causing the position of the meniscus to vibrate in each activated jets nozzle. γ can be the same or different from β. In some embodiments, γ is about 100 V or less (e.g., about 90 V or less, about 80 V or less, about 70 V or less, about 60 V or less, about 50 V or less, about 40 V or less, about 30 V or less, about 20 V or less). $T_{320}$ can be about 20 μs or less (e.g., about 15 μs or less, about 10 μs or less, about 8 μs or less, about 5 μs or less, about 4 μs or less, about 3 μs or less, about 2 μs or less, about 1 μs or less).

In embodiments, T is in a range from about 20 μs to about 500 μs, corresponding to a range of jetting frequencies from about 50 kHz to about 2 kHz. For example, in some embodiments, T corresponds to a jetting frequency of about 5 kHz or more (e.g., about 10 kHz or more, about 15 kHz or more, about 20 kHz or more, about 25 kHz or more, about 30 kHz or more).

Figure 3D:
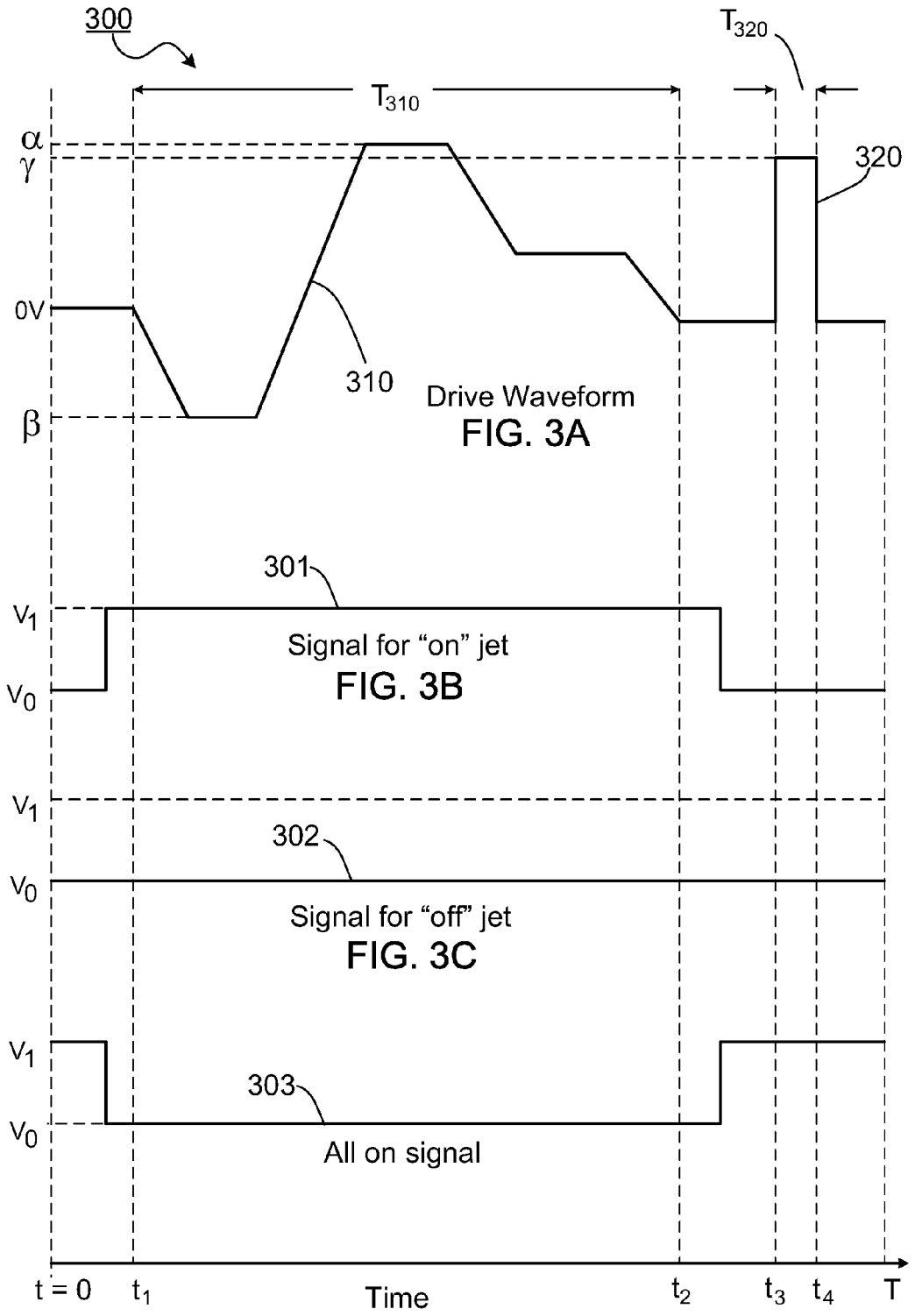
FIG. 3D is an all-on logic signal corresponding to the waveform cycle shown in FIG. 3A.

Logic signals corresponding to waveform 300 are shown in FIGS. 3B-3D. The logic signals are binary pulses, corresponding to two different voltage levels. A first state, at voltage $V_0$, causes an ink jet to be deactivated. In the other state, at voltage $V_1$, an ink jet is activated.

Referring specifically to FIG. 3B, a logic signal 301 is used to activate selected jets for jetting. Signal 301 switches from $V_0$ to $V_1$ at some time after t=0 but before $t_1$. Accordingly, the jet is activated prior to $t_1$, when pulse 310 is applied. Signal 301 switches back to $V_0$ at some time after $t_2$, but before $t_3$.

Referring to FIG. 3C, in the event that a jet is not activated, a logic signal 302 is used. Logic signal 302 does not change from $V_0$, so that the corresponding jet is not activated.

Referring to FIG. 3C, a third logic signal 303 is applied to all the jets in the ink jet module each cycle. Signal 303 switches from $V_1$ to $V_0$ prior to $t_1$, so that no jets are activated by signal 303 when pulse 310 is applied. However, between $t_2$ and $t_3$, signal 303 switches back to $V_1$, so that all jets are activated by $t_3$. This causes the controller to apply pulse 320 to all jets each cycle.

While in the foregoing embodiment, every ink jet in the module is activated for a tickle pulse every drive cycle regardless of whether the ink jet is activated for an ejection pulse, other implementations are also possible. For example, in some embodiments, each drive cycle, each ink jet can be activated either by a drive waveform or a tickle pulse. In other words, in each drive cycle, those ink jets that are not activated for the ejection pulse are activated for the tickle pulse, and vice versa.

Figure 4C:
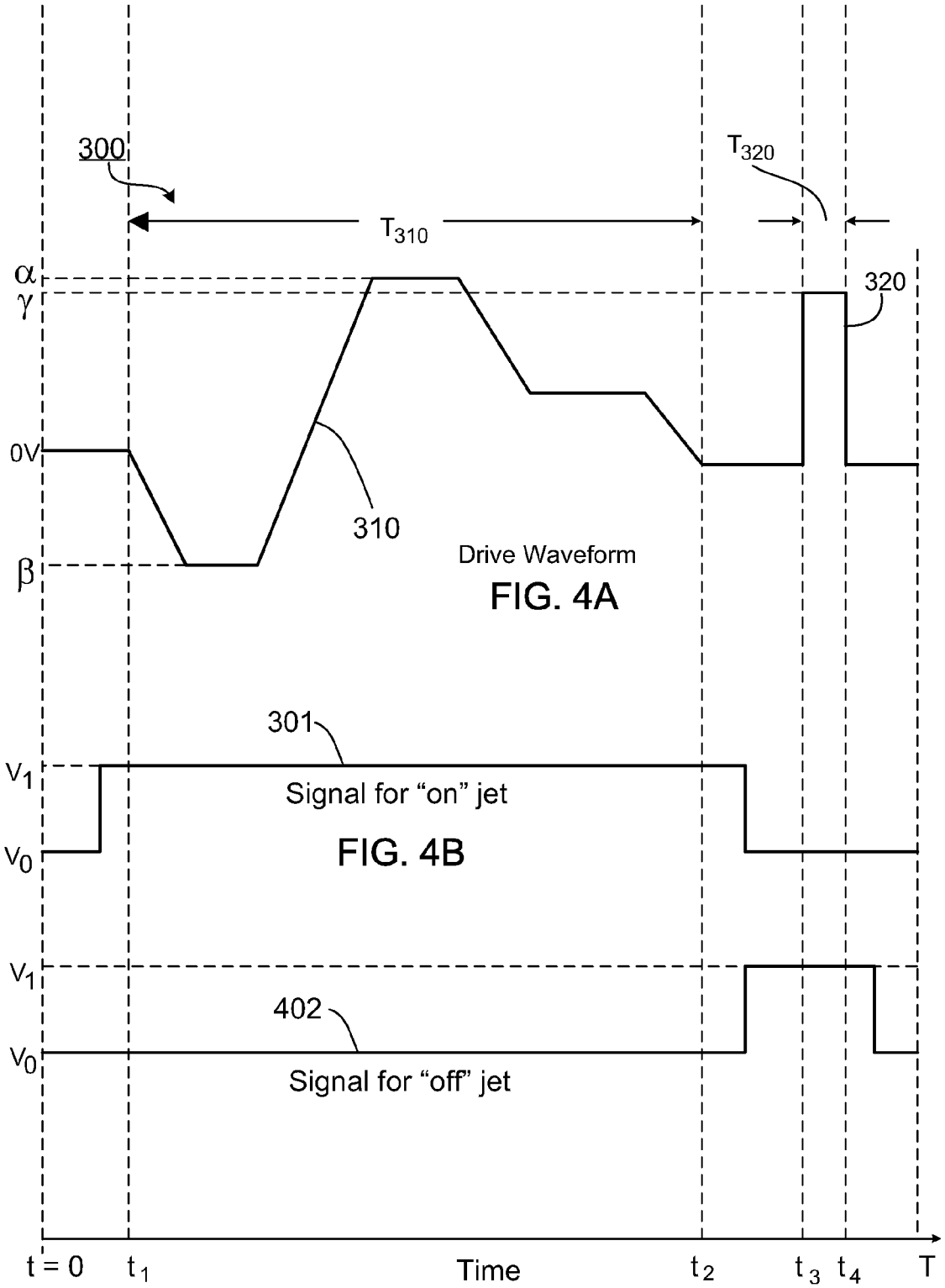
FIG. 4C is a logic signal for non-selected jets corresponding to the waveform cycle shown in FIG. 4A.

For example, referring to FIGS. 4A-4C, in some embodiments, an ink jet module can utilize the same drive waveform 300 as described above and shown in FIG. 3A, but with modified logic signals that activate jets for the tickle pulse only where the jet was inactive for the ejection pulse. As shown in FIG. 4B, the logic signal for "on" jets is the same as described above in relation to FIG. 3B. However, as shown in FIG. 4C, "off jet" logic signal 402 as at $V_0$ from t=0 until after $t_2$. At some time between $t_2$ and $t_3$, the signal switches to $V_1$, activating the jet prior to application of tickle pulse 320. As some time between $t_4$ and T, the signal switches from $V_1$ to $V_0$, deactivating the jet prior to the start of the subsequent jetting cycle.

The implementations described above utilize a single waveform which includes both an ejection pulse and a tickle pulse. More generally, however, implementations can include using different waveforms for the ejection pulse and tickle pulse.

Figures 5A, 5B:
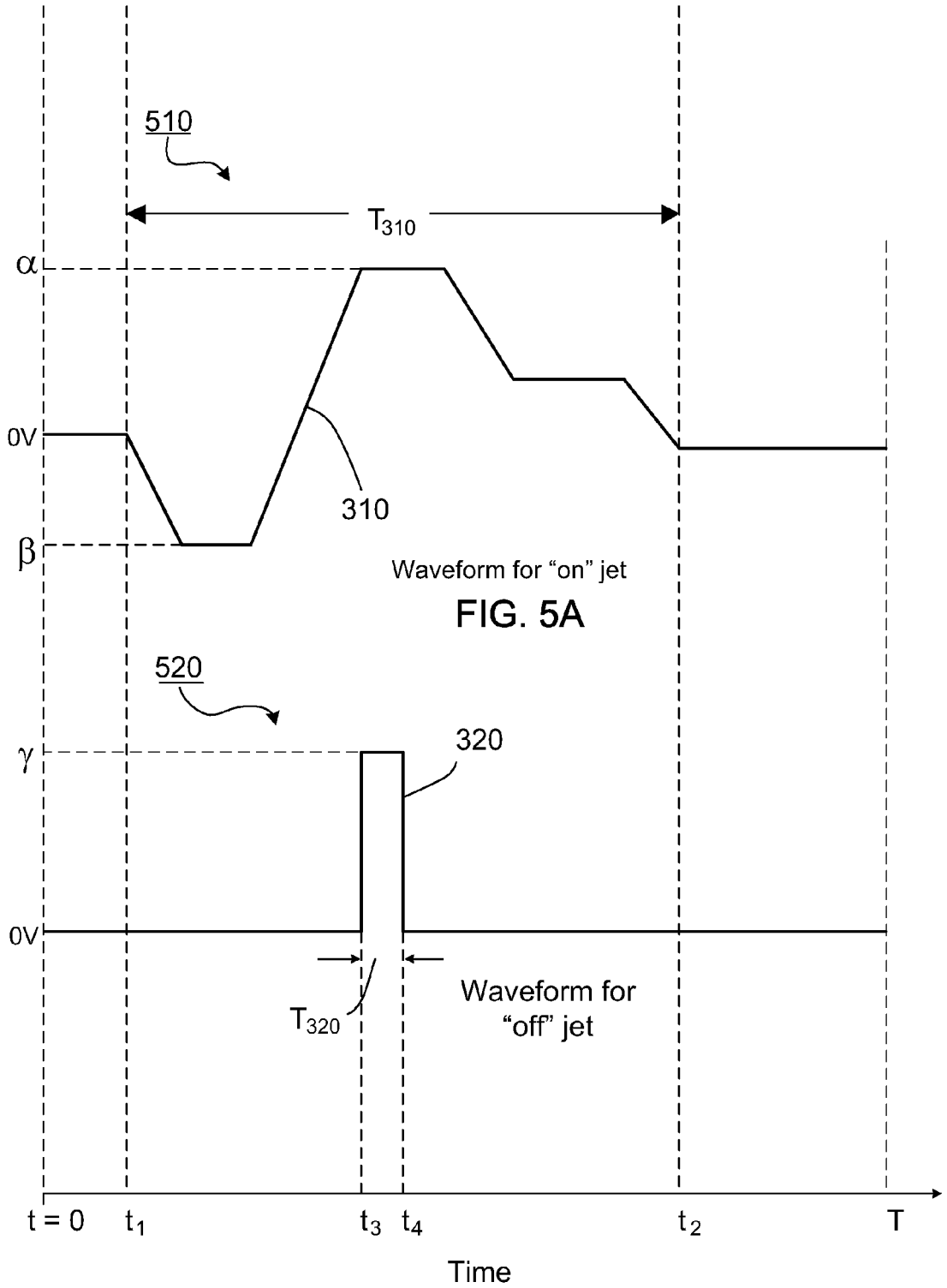
FIG. 5A is an example of a waveform cycle for selected jets.
FIG. 5B is an example of a waveform cycle for non-selected jets.

Referring to FIGS. 5A and 5B, for example, in some embodiments, each print cycle, an ink jet module can be driven with either a waveform 510 that includes an ejection pulse 310 but no tickle pulse, or a different waveform 520 that includes a tickle pulse 320 but no ejection pulse. Tickle pulse 320 can be applied to ink jets contemporaneously to applying ejection pulse 310 to other jets, as shown in FIGS. 5A and 5B, or can be applied non-contemporaneously.

In general, the design of the control circuitry used to generate the drive waveforms and to control delivery of the drive waveforms to individual jets may vary as desired. Typically, the drive waveform is provided by a waveform generating device such as an amplifier (or other electronic circuit) that outputs the desired waveform based on a lower voltage waveform supplied to the amplifier. Ink jet modules may utilize a single waveform generating device, or multiple devices. In some embodiments, each ink jet in an ink jet module can utilize its own individual waveform generating device.

Although the waveform shown in FIGS. 3A, 4A and 5A have a particular shape, in general, waveform shape can vary as desired. For example, ejection pulse 310 can be bipolar or unipolar. Pulse 310 can include triangular, rectangular, trapezoidal, sinusoidal, and/or exponentially, geometrically, or linearly varying portions. Similarly, pulse 320 can be bipolar or unipolar. Moreover, while pulses 320 are rectangular in the in FIGS. 3A, 4A, and 5A, in general, these pulses can include triangular, rectangular, trapezoidal, sinusoidal, and/or exponentially, geometrically, or linearly varying portions. Furthermore, while ejection pulses and/or tickle pulses can be more complex waveforms than those illustrated in FIGS. 3A-5B. For example, an ejection pulse may include multiple oscillations. Examples of ejection pulses that include multiple oscillations are described in U.S. patent application Ser. No. 10/800,467, entitled "HIGH FREQUENCY DROPLET EJECTION DEVICE AND METHOD," filed on Mar. 15, 2004, the entire contents of which are hereby incorporated by reference. In some embodiments, a tickle pulse can include multiple oscillations.

In general, ink jet modules, such as ink jet module 12, can be used to jet a variety of fluids, such as various inks (e.g., UV curing ink, solvent-based ink, hot-melt ink) and or liquids, including liquids containing adhesive materials, electronic materials (e.g., electrically conductive or insulating materials), or optical materials (such as organic LED materials).

Furthermore, the jetting schemes discussed can be adapted to other droplet ejection devices in addition to those described above. For example, the drive schemes can be adapted to ink jets described in U.S. patent application Ser. No. 10/189,947, entitled "PRINTHEAD," by Andreas Bibl and coworkers, filed on Jul. 3, 2003, and U.S. patent application Ser. No. 09/412,827, entitled "PIEZOELECTRIC INK JET MODULE WITH SEAL," by Edward R. Moynihan and coworkers, filed on Oct. 5, 1999, the entire contents of which are hereby incorporated by reference.

A number of embodiments of the invention have been described. Nevertheless, it will be understood that various modifications may be made without departing from the spirit and scope of the invention. Accordingly, other embodiments in the claims.

What is claimed is:

1. A method of driving an inkjet module that comprises a plurality of ink jets, the plurality of ink jets including a first ink jet, the method comprising:

during a jetting cycle in which only the first ink jet of the plurality of ink jets ejects only one droplet of fluid:

applying a first signal to the first ink jet;

while applying the first signal to the first ink jet, applying a first pulse of a voltage waveform to the first ink jet so that the first ink jet ejects the droplet of fluid, the first pulse comprising a plurality of oscillations;

during the jetting cycle, after applying the first signal to the first ink jet, applying a second signal to the plurality of ink jets including the first ink jet; and while applying the second signal to the plurality of ink jets including the first ink jet, applying a second pulse of the voltage waveform to the plurality of ink jets so that a fluid meniscus of ink in each of the plurality of ink jets moves without ejecting a droplet, the second pulse being different from the first pulse.

2. The method of claim 1, wherein, during the jetting cycle, the first pulse is applied to the first ink jet before the second pulse is applied to the plurality of ink jets including the first ink jet.

3. The method of claim 1, wherein the second pulse comprises a plurality of oscillations.

4. The method of claim 1, comprising repeating the method for each of a plurality of jetting cycles, wherein during each jetting cycle the first ink jet ejects only one droplet of fluid.

5. The method of claim 1, comprising applying the voltage waveform to the inkjet module periodically.

6. The method of claim 1, wherein each ink jet of the inkjet module comprises a piezoelectric transducer.

7. The system of claim 1, comprising delivering the same voltage waveform to different ink jets.

8. The method of claim 1, wherein the first pulse comprises a bipolar pulse.

9. The method of claim 1, wherein the first pulse comprises a first trapezoidal portion of negative voltage and a second portion having positive voltage.

10. The method of claim 1, wherein the second pulse comprises a unipolar pulse.

11. A system for driving ink jets, the system comprising:

an inkjet module comprising a plurality of ink jets, the plurality of ink jets including a first ink jet; and an electronic controller configured so that, during use of the system during a jetting cycle in which only the first ink jet of the plurality of ink jets ejects only one droplet of fluid:

a first signal is applied to the first ink jet;

while the first signal is applied to the first ink jet, a first pulse of a voltage waveform is applied to the first ink jet so that the first ink jet ejects the droplet of fluid, the first pulse comprising a plurality of oscillations;

during the jetting cycle, after applying the first signal to the first ink jet, a second signal is applied to the plurality of ink jets including the first ink jet;

while the second signal is applied to the plurality of ink jets including the first ink jet, a second pulse of the voltage waveform is applied to the plurality of ink jets so that a fluid meniscus of ink in each of the plurality of ink jets moves without ejecting a droplet, the second pulse being different from the first pulse.

12. The system of claim 11, wherein, during the jetting cycle, the first pulse is applied to the first ink jet before the second pulse is applied to the plurality of ink jets including the first ink jet.

13. The system of claim 11, wherein the second pulse comprises multiple oscillations.

14. The system of claim 11, wherein the electronic controller is configured so that during use of the system, the voltage waveform is applied to the inkjet module periodically.

* * * * *